US005515018A

United States Patent [19]

DiMarco et al.

[11] Patent Number: 5,515,018

[45] Date of Patent: May 7, 1996

[54] PIVOTING CIRCUIT BREAKER LOAD TERMINAL

[75] Inventors: Bernard DiMarco, Lilburn; James E. Ferree, Lawrenceville, both of Ga.

[73] Assignee: Siemens Energy & Automation, Inc., Alpharetta, Ga.

[21] Appl. No.: 348,018

[22] Filed: Dec. 1, 1994

Related U.S. Application Data

[63] Continuation of Ser. No. 314,467, Sep. 28, 1994.

[51] Int. Cl.[6] ..... H01H 75/00

[52] U.S. Cl. ..... 335/16; 335/172; 335/195; 218/22

[58] Field of Search ..... 335/16, 147, 195, 335/8–10, 167–176, 23–25; 200/147 R

[56] References Cited

U.S. PATENT DOCUMENTS

| | | | |
|---|---|---|---|
| 4,594,567 | 6/1986 | DiMarco et al. | 335/16 |
| 4,595,896 | 6/1986 | DiMarco et al. | 335/202 |
| 4,680,564 | 7/1987 | DiMarco et al. | 335/16 |
| 5,073,764 | 12/1991 | Takahashi et al. | 335/202 |
| 5,146,194 | 9/1992 | Altenhof, Jr. et al. | 335/16 |
| 5,184,099 | 2/1993 | DiMarco et al. | 335/16 |
| 5,319,166 | 6/1994 | Arnold et al. | 200/144 R |

*Primary Examiner*—Lincoln Donovan

[57] ABSTRACT

An improved circuit breaker with moving line and load contacts is disclosed herein. The circuit breaker includes an enclosure for the operational components thereof including a line contact arm and associated contact for each phase of the circuit breaker, and an operating mechanism supported within the enclosure to move the contact arm(s) between open and closed positions. The circuit breaker also includes a terminal for each phase pivotally supported within the enclosure, and a load contact arm and associated contact for each phase pivotally connected to the terminal. The contact arms are supported so the contacts are engaged when the line contact arms are in the closed positions. The pivoted load terminal(s) allow the use of multiple connector types with the terminal(s), and the pivoting connection between the load contact arm and associated terminal facilitates a reduction in circuit breaker size for a given rating.

20 Claims, 4 Drawing Sheets

FIG. 3
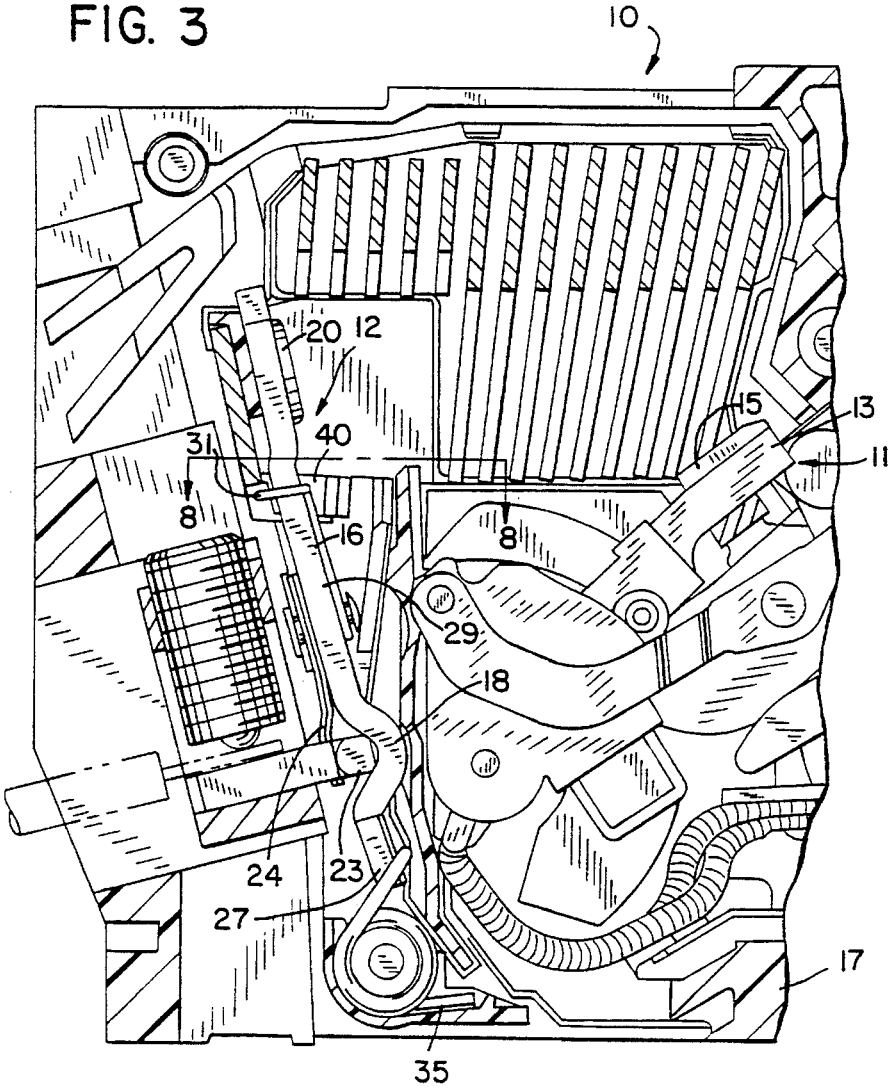
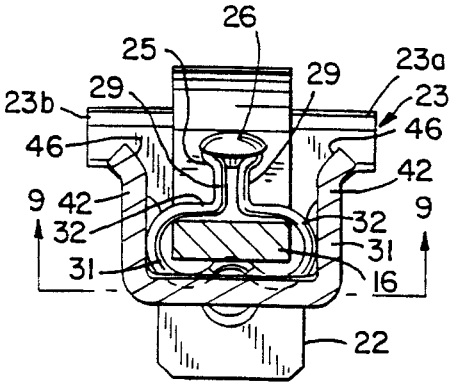
FIG. 8
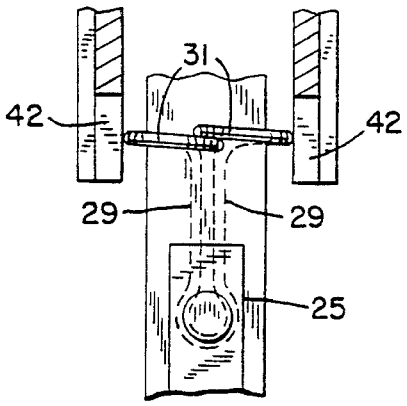
FIG. 9

PIVOTING CIRCUIT BREAKER LOAD TERMINAL

RELATED APPLICATIONS

This application is a continuation of patent application Ser. No. 08/314,467 filed on Sep. 28, 1994, entitled a Circuit Breaker With Moveable Main Contact Multi-Force-Level Biasing Element.

FIELD OF THE INVENTION

The present invention relates generally to the load terminal(s) of a circuit breaker. In particular, the present invention relates to a pivoting load terminal which can be pivoted to engage a cable extending from the back of the circuit breaker or from one side of the circuit breaker.

BACKGROUND OF THE INVENTION

Typical circuit breakers include load and line terminals which provide electrical connections between the load and line conductors and the circuit breaker. These terminals have a fixed position or configuration depending upon the application for the circuit breaker. More specifically, the terminals can have a number of positions or configurations depending upon whether the conductors connected to the circuit breaker are connected at the side or back of the circuit breaker. However, these positions and configurations are established when the circuit breaker is manufactured, and are not readily modified when the circuit breaker is used in the field. Additionally, regardless of the position or configuration of the terminals, these terminals are rigidly positioned in the circuit breaker and, in use, can not be repositioned to accommodate conductors which are oriented such that they are difficult to connect to the terminal (e.g. a 00 gauge conductor which is skewed and must be deflected with substantial force to be properly connected to the lug associated with the terminal). By way of example, see U.S. Pat. No. 5,361,051 issued on Nov. 1, 1994 to Bernard Di Marco.

In addition to the problem of connecting poorly oriented conductors to the terminals of a circuit breaker, there is a need to reduce the size of circuit breakers for a given current interrupting rating. Accordingly, circuit breakers have been designed with moving load contacts which increase the speed and distance between the line and load contacts when separating in response to a short circuit condition. An example of such a circuit breaker is disclosed in U.S. Pat. No. 4,594,567, issued on Jun. 10, 1986. This type of circuit breaker is typically smaller than a circuit breaker of equal rating having a fixed load contact, but requires added components such as a load contact pivot and camming arrangement. Accordingly, elimination or reduction in size of any of these added components would further reduce the size of the circuit breaker.

In view of the circuit breaker configurations discussed above, it would be desirable to provide an improved terminal configuration to improve the ability to connect a conductor to the circuit breaker. Additionally, it would be desirable to provide a terminal configuration which reduces the size of a circuit breaker for a given rating.

SUMMARY OF THE INVENTION

The present invention provides an electric switch including an enclosure, a first contact moveable between first and second positions within the enclosure, and an operating mechanism supported by the enclosure and coupled to the first contact to move the first contact between positions. The switch also includes a terminal supported by the enclosure and exposed to the exterior of the enclosure, and a second contact arm including a second contact, and pivotally and electrically connected to the terminal at the interior of the enclosure. The contact arms are arranged so the first contact engages the second contact when the first contact is in the first position.

The present invention further provides a circuit breaker including a base including a top side and a bottom side, a first contact arm including a first contact moveable between first and second positions, and an operating mechanism supported by the top side of the base and coupled to the first contact arm to move the first contact arm between positions. The circuit breaker also includes a terminal pivotally connected to the top side of the base, and a second contact arm including a second contact and pivotally connected to the terminal. The contact arms are supported so that first contact engages the second contact when the first contact arm is in the first position.

Another configuration of the circuit breaker includes three phases. This multi-phase circuit breaker includes a base, at least three line contact arms each including a line contact and moveable between first and second positions, and an operating mechanism supported by the base and coupled to the line contact arms to move the line contact arms between positions. The circuit breaker also includes at least three load terminals pivotally connected to the base, and at least three load contact arms each including a load contact. Each of the load contact arms being pivotally connected to one of the respective load terminals, where the first contacts engage the second contacts when the first contact arms are in the first position.

BRIEF DESCRIPTION OF THE DRAWINGS

FIG. 3 is a view similar to FIG. 2 showing the contact blades in the blown open position;

FIG. 8 is a view taken on line 8—8 of FIG. 3;

FIG. 9 is a view taken on line 9—9 of FIG. 8; and

DETAILED DESCRIPTION OF THE PREFERRED EMBODIMENTS

Figure 1:
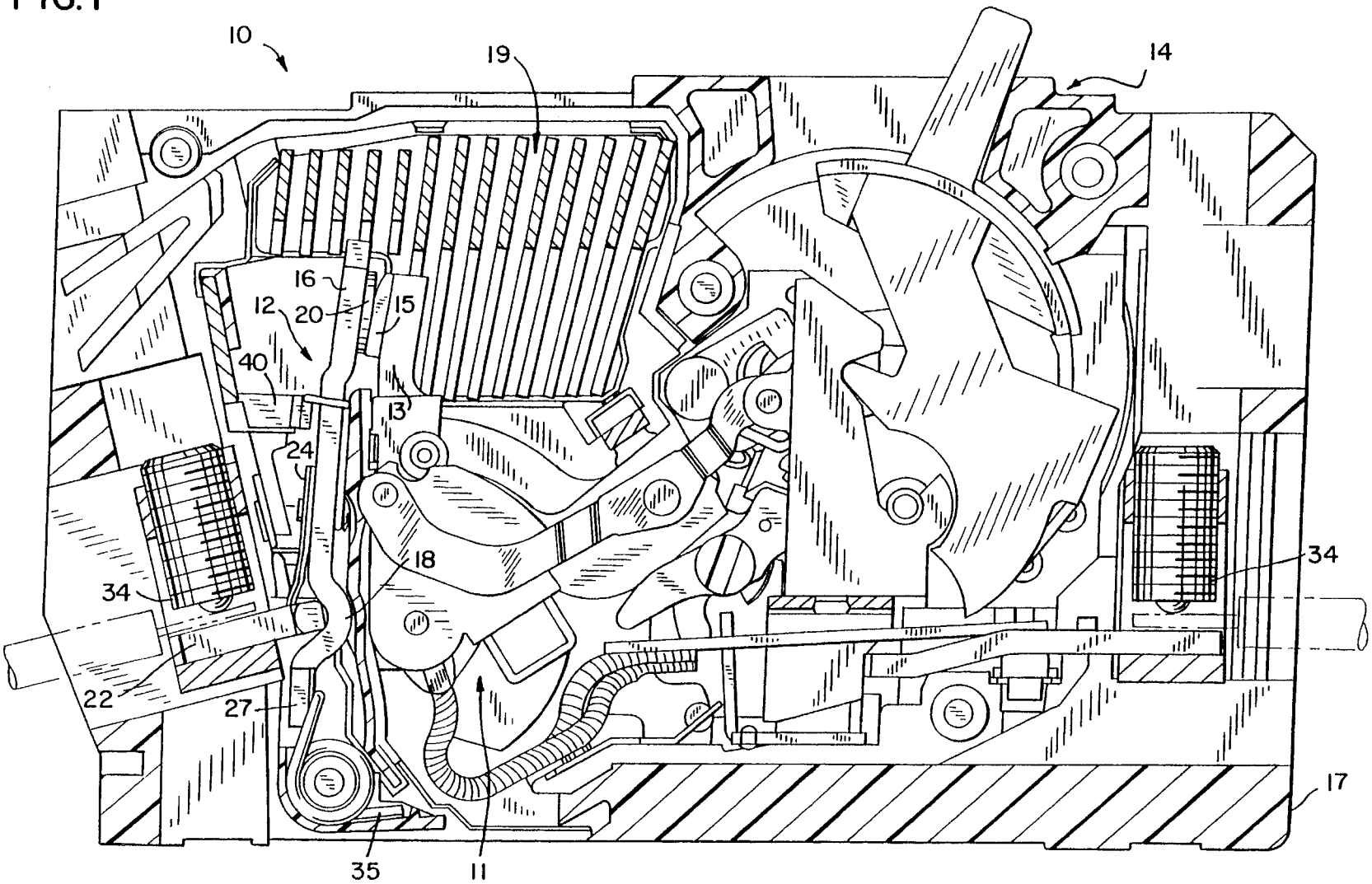
FIG. 1 is a side elevation view, partly broken away, of the molded case circuit breaker according to the present invention with the contact blades shown in the closed position.
Figure 2:
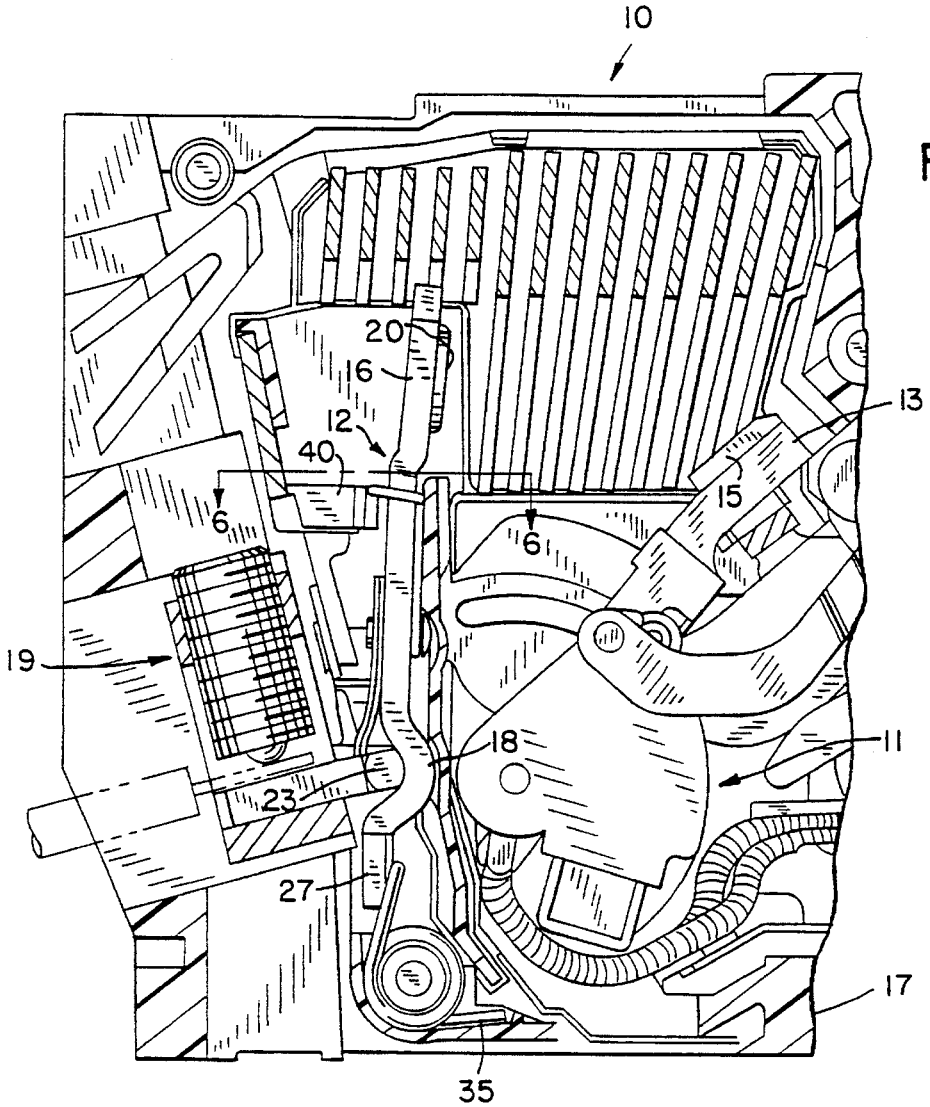
FIG. 2 is a partial view of FIG. 1 showing the contact blades in the open position.

Referring to FIG. 1, a circuit breaker 10 includes an enclosure having a base 17, a line contact blade assembly 11, a load contact blade assembly 12, an arc chamber 19 supported by the enclosure above the contact blade assemblies 11 and 12 and a contact operating mechanism 14. The blade assemblies 11 and 12 are pivotally supported by base 17. The line contact blade assembly 11 is shown in the closed position in FIG. 1, and in the open position in FIG. 2. Assemblies 11 and 12 are shown in the blown open position in FIG. 3. Line contact blade assembly 11 generally includes a blade 13 having an electrical contact 15 on the upper end. Blade 13 is pivotally supported by base 17.

Operating mechanism 14 is supported by base 17 and provided for moving blade assembly 11 between open and closed positions with respect to load contact blade assembly 12. Depending upon the application (i.e. single or multi-pole), operating mechanism 14 will interact with a crossbar to move multiple assemblies 11 simultaneously. The present embodiment of circuit breaker 10 includes three poles. However, for purposes of clarity, only a single pole of circuit breaker 10 is described herein. By way of example, operating mechanism 14 can be configured as shown and described in U.S. Pat. No. 4,594,567 noted above.

Load contact blade assembly 12 generally includes a blade 16 having V-shaped offset bearing section 18 at the lower end and an electrical contact 20 at the upper end which is positioned to engage electrical contact 15 on line contact blade 13. A terminal strap 22 having a multi-sided (e.g., octagonal) cross piece or shaft 23 which is seated in bearing section 18 and retained therein by a leaf spring 24 which is secured to the blade 16 by a rivet 26. Alternatively, shaft 23 could have a circular cross-section. The lower end of the spring 24 projects into an opening 28 in the terminal strap 22. Strap 22 is pivotally supported at the end bearing portions **23*a* and 23*b* of piece 23 by an appropriate bearing structure in base 17 (e.g. molded recess). For example, portions 23*a* and 23*b* could be captured between base 17 and the top portion of the circuit breaker 10 enclosure when base 17 and the top portion are joined. Thus, strap 22 can pivot about the axis of shaft 23 relative to base 17**.

Figure 10:
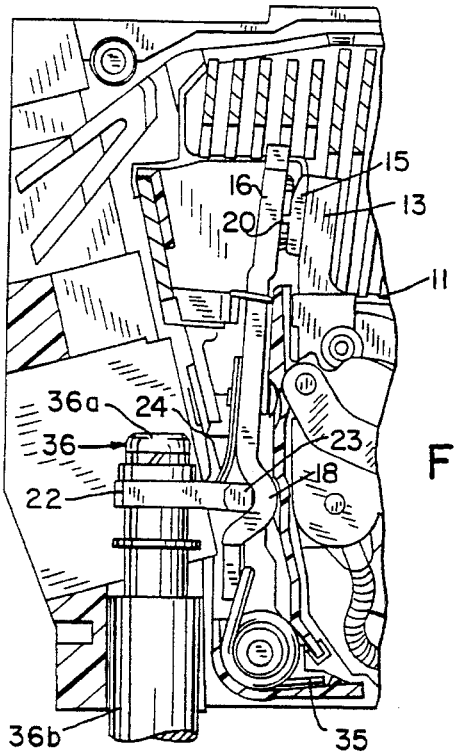
FIG. 10 is a view of an alternate terminal connection arrangement.

A feature of this arrangement is the dual function of terminal strap 22 which allows load contact blade 16 to pivot or rotate generally about the axis of cross piece 23 and allows terminal strap 22 to rotate into a plurality of positions relative to base 17. With this arrangement the terminal strap 22 can be pivoted to engage a clamp-type line connector 34, as shown in FIG. 1, or pivoted to engage a threaded line connector 36, as shown in FIG. 10. Connector 36 includes a threaded fastener **36*a* which passes through an opening in terminal 22 and engages the threads of a threaded wire end 36*b*. The conductor is attached to terminal 22 so the axis of the end portion of the conductor is substantially coincident with the axis of fastener 36*a***.

Load contact blade assembly 12 is pivoted about piece 23 and biased into engagement with the line contact blade assembly 11 by a return spring 35 in the form of a torsion spring which is mounted on base 17 in a position to engage lower end 27 of load contact blade 16.

The dual position of terminal 22 allows an increased arc chamber design, for improved operation of the circuit breaker under short circuit conditions, without extending the length of the overall circuit breaker. The angular position of terminal 22 as shown in FIG. 1 allows access to the wire clamping screw of connector 34 from the front of circuit breaker 10, while the position of terminal 22 as seen in FIG. 10 allows connection from the rear of circuit breaker 10.

Another advantage of the present configuration is the provision of V-shaped offset bearing section 18 of load contact blade 16 which makes contact with the cross piece 23 of terminal strap 22. The crosspiece 23 is seated against the angled sides of the V-shaped bearing section 18. This configuration increases the contact forces between the blade 16 and the strap 22. The contact forces with the V-shaped bearing are greater than they would be with, for example, a circular-shaped journal bearing. It is advantageous to increase these contact forces for two reasons. First, because electrical current is conducted through this bearing, the increased contact forces tend to reduce the resistance to electrical current flow through the bearing surfaces. Accordingly, by reducing electrical resistance, this also reduces the amount of heat produced in the bearing. Second, it is important to have sufficiently high contact forces in order to counteract the effects of current constriction forces in the bearing interface. Typically, when two electrical conductors make physical contact with each other, and an electrical current flows from one conductor into the other through the contact interface, an electrodynamic repulsion force, due to the phenomenon of current constriction, arises between the two parts which tends to separate them. In the bearing surface between the load contact blade 16 and the terminal strap 22, such separation would be undesirable because it would result in an electric arc which would damage the bearing surfaces. The increased contact forces of the present configuration help to prevent separation from occurring.

Figure 6:
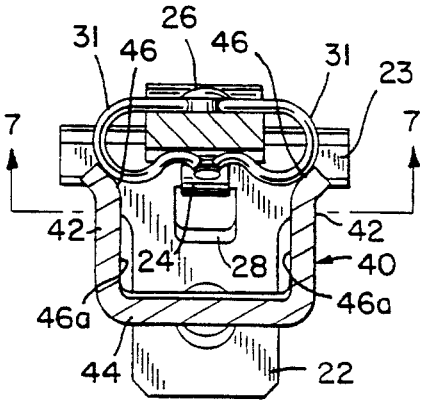
FIG. 6 is a view taken on line 6—6 of FIG. 2 showing the contact pressure spring assembly.
Figure 7:
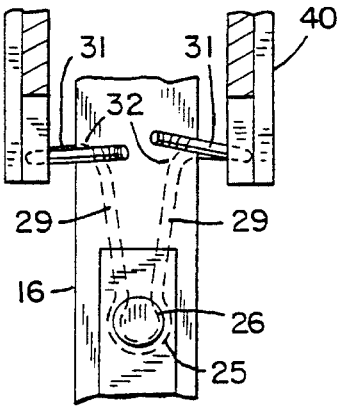
FIG. 7 is a view taken on line 7—7 of FIG. 6.
Figure 4:
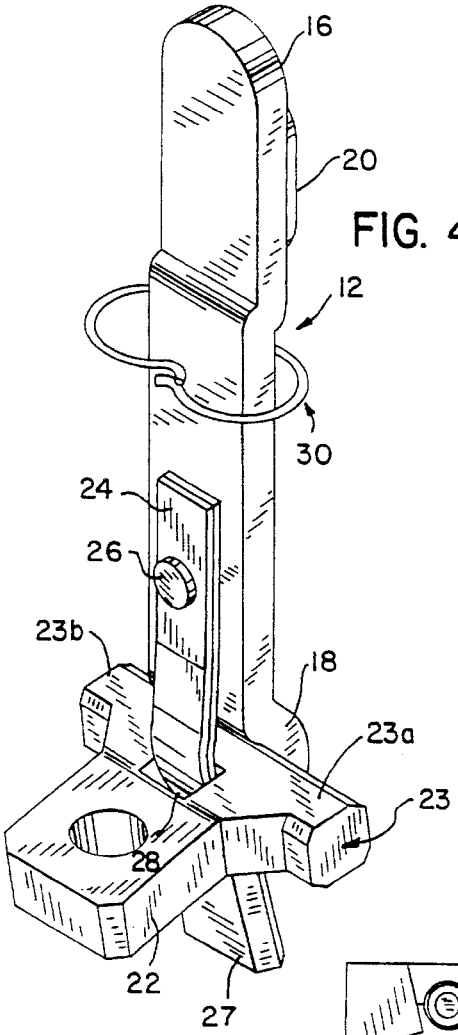
FIG. 4 is a perspective view of the load contact blade assembly.
Figure 5:
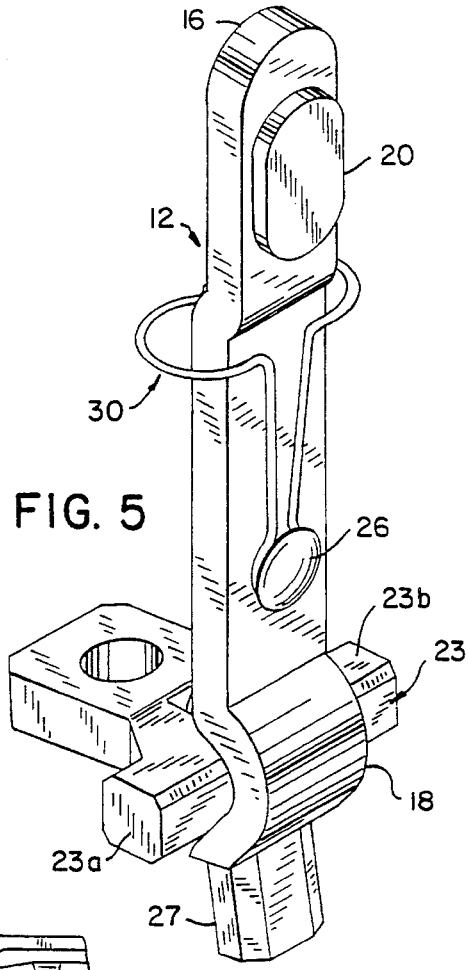
FIG. 5 is a perspective view of the load contact blade assembly.

A contact pressure wire spring 30 is mounted on the front of the load contact blade 12 by rivet 26 for leaf spring 24. Spring 30 as shown in FIGS. 6 and 7 includes a semi-circular loop 25 fixed to blade 16 by rivet 26. A pair of legs (i.e., beam spring portions) 29 are provided on the ends of loop 25 which diverge outwardly. A second semi-circular loop 31 is formed at the upper end of each of the legs 27. Loops 31 are bent at a right angle to the upper end of each leg 29. Loops 31 are biased outwardly by diverging legs 29 on loop 25.

A U-shaped channel member 40 is formed from a single piece of sheet steel or other ferrous material and includes a pair of side walls 42 extending outwardly from a base 44. A pair of opposed spring cam surface are provided by a surface 46 on the outer edges of each of side walls 42 extending at a predetermined angle (e.g. 25–65 degrees) from the parallel portion **46*a* of member 40. U-shaped member 40 is magnetically attracted to the loops 31 and blade 16 due to the magnetic field produced by the current in blade 16. This attraction delays the release of blade 16 and loops 31 from U-shaped channel member 40 until the arc between contacts 15 and 20 is extinguished. When the arc is extinguished and the blow apart forces subside, the return spring 35 will bias load contact blade assembly 12** to its original position.

In operation, loops 31 are initially in direct engagement with cam surfaces 46 when the load contact blade assembly 12 is in the closed position. The wire form spring 30, in combination with the return spring 35, and the interaction of piece 23, section 18 and leaf spring 24, holds the electric contact 20 on the load contact blade 16 in engagement with the electric contact 15 on the line contact blade 13 with an appropriate force. When the electromagnetic forces (i.e., blow apart) caused by the substantially parallel and opposite currents in blades 13 and 16 exceed a predetermined limit (i.e., during short circuit conditions), loops 31 slide along cam surfaces 46, are compressed and move to engage side walls 42 of U-shaped member 40. Upon engaging walls 42, the force loops 31 produce to restrict movement of blade 16 (i.e., counter-clockwise rotation) are greatly reduced to facilitate contact blow apart.

Although the invention has been described in conjunction with specific embodiments thereof, it is evident that alternatives, modifications and variations will be apparent to those skilled in the art. For example, the position of springs 30 and U-shaped channel member 40 could be reversed so that member 40 is fastened to arm 16 and spring 30 is fixed relative to base 17. It is intended that the claims embrace all such alternatives, modifications and variations that fall within the spirit and broad scope of the appended claims.

What is claimed is:

1. An electric switch comprising:

an enclosure;

a first contact moveable between first and second positions within the enclosure;

an operating mechanism supported by the enclosure and coupled to the first contact to move the first contact between positions;

a terminal pivotally supported by the enclosure and exposed to the exterior of the enclosure; and a second contact arm including a second contact, and pivotally and electrically connected to the terminal at the interior of the enclosure, the first contact engaging the second contact when the first contact is in the first position.

2. The switch of claim 1, wherein the terminal includes a shaft pivotally attached to the enclosure.

3. The switch of claim 2, wherein the second contact arm includes a bearing portion pivotally attached to the shaft.

4. The switch of claim 3, wherein the bearing portion includes a bearing offset section in contact with the shaft and a spring member attached to the second contact arm and in contact with the shaft.

5. The switch of claim 3 further comprising a line connector clamp mechanically attached to the terminal.

6. The switch of claim 3, wherein the terminal includes an opening accessible from the exterior of the circuit breaker, and the circuit breaker further comprises a threaded wire end fastened to the terminal by a threaded fastener passing through the opening, the wire end being electrically connectable to an end portion of a conductor such that the longitudinal axis of the end portion of the conductor is parallel with the axis of the threaded fastener.

7. A circuit breaker comprising:

a base including a top side and a bottom side;

a first contact arm including a first contact and moveable between first and second positions;

an operating mechanism supported by the base and coupled to the first contact arm to move the first contact arm between positions;

a terminal pivotally connected to the base; and a second contact arm including a second contact arm pivotally connected to the terminal, the first contact engaging the second contact when the first contact arm is in the first position.

8. The circuit breaker of claim 7, wherein the terminal includes a shaft pivotally attached to the base.

9. The circuit breaker of claim 8, wherein the second contact arm includes a bearing portion pivotally attached to the shaft.

10. The circuit breaker of claim 9, wherein the bearing portion includes an arcuate offset section in contact with the shaft and a spring member attached to the second contact arm and in contact with the shaft.

11. The circuit breaker of claim 10, wherein the terminal includes an exterior portion accessible from the exterior of the circuit breaker.

12. The circuit breaker of claim 11 further comprising a line connector clamp mechanically attached to the exterior portion.

13. The circuit breaker of claim 11, wherein the exterior portion includes an opening, and the circuit breaker further comprises a threaded wire end fastened to the terminal by a threaded fastener passing through the opening, the wire end being electrically connectable to an end portion of a conductor such that the longitudinal axis of the end portion of the conductor is parallel with the axis of the threaded fastener and extends outwardly from the bottom side of the base.

14. A multi-phase circuit breaker comprising:

a base;

at least three line contact arms each including a line contact and moveable between first and second positions;

an operating mechanism supported by the base and coupled to the line contact arms to move the line contact arms between positions;

at least three load terminals pivotally connected to the base; and at least three load contact arms each including a load contact, each of the load contact arms being pivotally connected to one of the respective load terminals, the first contact engaging the second contact when the first contact arm is in the first position.

15. The circuit breaker of claim 14, wherein the terminals each include a shaft pivotally attached to the base.

16. The circuit breaker of claim 15, wherein the second contact arms each include a bearing portion pivotally attached to one of the respective shafts.

17. The circuit breaker of claim 16, wherein the bearing portions each include an offset section in contact with the respective shaft, and a spring member attached to the respective second contact arm and in contact with the respective shaft.

18. The circuit breaker of claim 17, wherein the terminals each include an exterior portion accessible from the exterior of the circuit breaker.

19. The circuit breaker of claim 18 further comprising one line connector clamp mechanically attached to each exterior portion.

20. The circuit breaker of claim 19, wherein the exterior portion includes an opening, and the circuit breaker further comprises one threaded wire end fastened to each exterior portion by a threaded fastener passing through the opening, each wire end being electrically connectable to an end portion of a conductor such that the longitudinal axis of the end portion of the conductor is parallel with the axis of the respective threaded fastener and extends outwardly from the bottom side of the base.

* * * * *